US005542355A

United States Patent [19]

Madison et al.

[11] Patent Number: 5,542,355

[45] Date of Patent: Aug. 6, 1996

[54] TIE PLATE TRACK FASTENER FEEDER

[75] Inventors: Harry Madison, Memphis, Tenn.; Charles R. Schultz, Welcome, Minn.

[73] Assignee: Harsco Corporation, Wormleysburg, Pa.

[21] Appl. No.: 306,921

[22] Filed: Sep. 16, 1994

[51] Int. Cl.[6] ..... E01B 29/26

[52] U.S. Cl. ..... 104/17.1; 221/290; 221/298

[58] Field of Search ..... 104/2, 17.1; 227/135; 221/290, 293, 294, 298

[56] References Cited

U.S. PATENT DOCUMENTS 4,554,624 11/1985 Wickham et al. ..... 364/148
4,928,600 5/1990 Urmson, Jr. et al. ..... 104/17.1

*Primary Examiner*—S. Joseph Morano
*Attorney, Agent, or Firm*—Kerkam, Stowell, Kondracki & Clarke, P.C.; Edward J. Kondracki; William L. Feeney

[57] ABSTRACT

A rail spike feeder, which may feed regular spikes, hairpin or lock spikes, and coach screws, uses a holder which receives spikes from a spike chute. The spikes do not assume any secure position from exiting the spike chute until after contact with the holder. The holder uses a four bar linkage arrangement such that the holder pivots about ends of first and second links at the same time the opposite ends of the links are swinging or pivoting about their mounts. This maintains a proper orientation for spikes moved into a spiking position whereat a spiker head, such as a spike hammer, may insert the spikes into tie plates and ties. A counterweighted finger assembly is used to maintain spike orientation as spikes are transferred from the spike chute to the holder.

20 Claims, 11 Drawing Sheets

FIG. 2
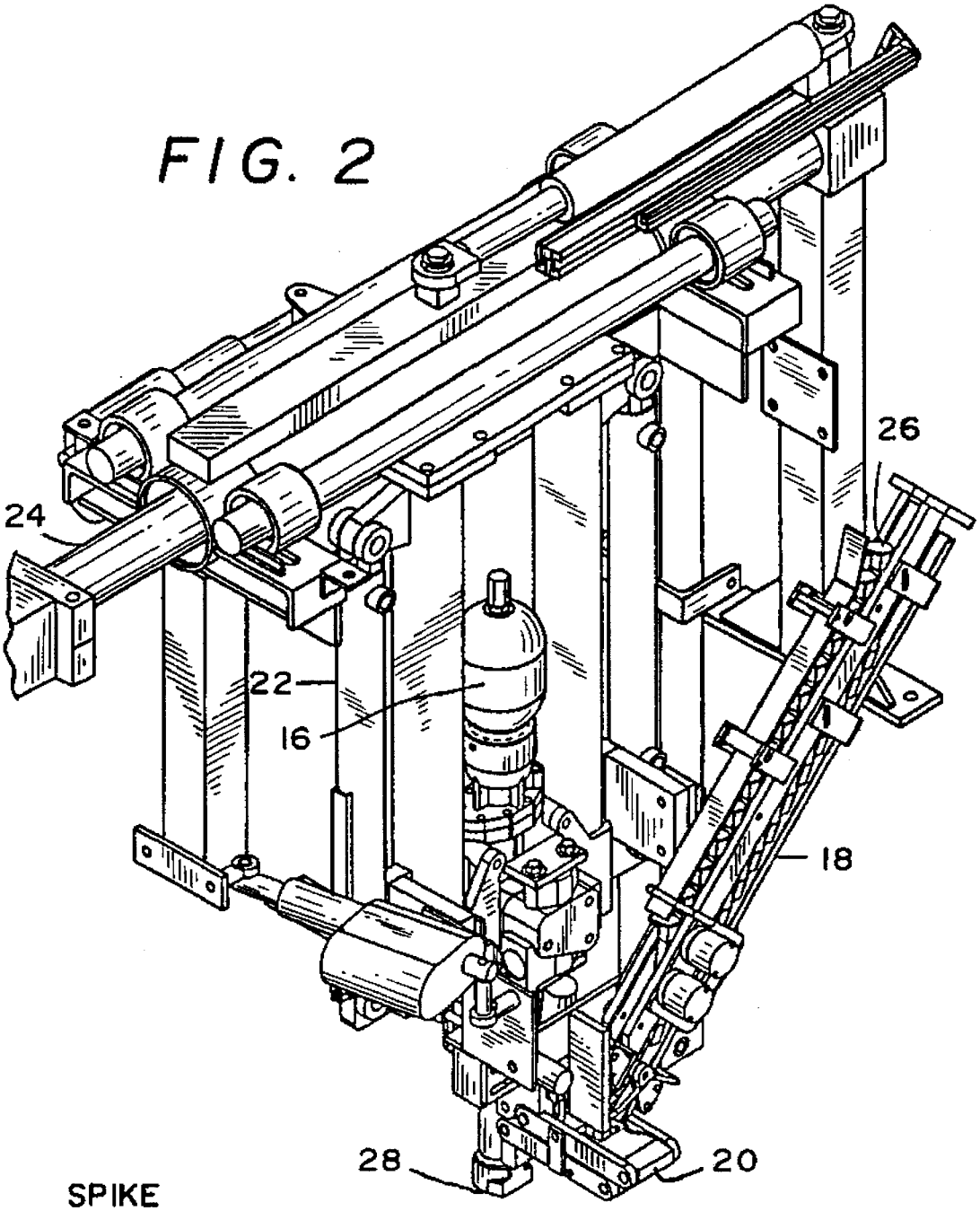
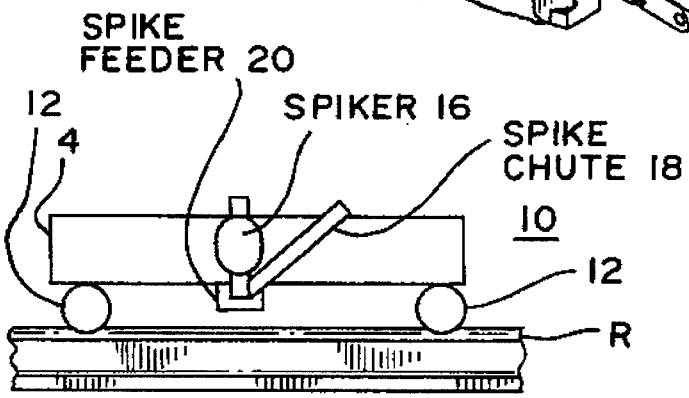
FIG. 1

TIE PLATE TRACK FASTENER FEEDER

BACKGROUND OF THE INVENTION

The present invention relates to an apparatus for feeding tie plate track fasteners to a rail spiker and the assembly of the tie plate track fastener feeder with the rail spiker and associated mechanisms on a rail spiking vehicle.

When laying new railroad rails and when repairing old railroad tracks as by replacing old ties, it is often necessary to secure tie plates to the cross ties. The insertion of tie plate spikes (or other tie plate track fasteners such as hairpin or lock spikes and coach screws) secures the plates to the ties and the plates in turn secure the rails in position.

Various spike feeding and holding arrangements have previously been used. Among these are arrangements disclosed or shown in the following U.S. Patents, hereby incorporated by reference, and assigned to the assignee of the present invention:

| Inventor | U.S. Pat. No. | Issue Date |
|---|---|---|
| Urmson, Jr. et. al | 4,928,600 | May 29, 1990 |
| Wickham et. al | 4,554,624 | November 19, 1985 |

Urmson shows use of angled jaws for a spike holding mechanism, whereas Wickham shows a spiking apparatus combined with measuring and gauging systems. Wickham has spikes fed from a spike chute into a holder for insertion by a spike head, such as a ram guide or spike hammer which uses hydraulic power to insert a spike through preexisting holes in a tie plate and forcibly create corresponding holes in the tie below the tie plate preexisting holes.

Although those and various other spike feeding arrangements have been useful, they are often subject to one or more of various disadvantages.

Often a spike is released from a spike chute and passed to secure position (i.e., stationary with respect thereto) on an intermediate spike holder only to be handed off to assume a secure position on a final spike holder (such as a pair of jaws). The spike hammer then hammers the spike from its position on the final spike holder. The handoff or passing off of the spike twice (first handoff from chute to intermediate spike holder, second from intermediate spike holder to final spike holder) presents multiple opportunities for malfunction and often requires various complex manipulations to properly orient the spikes. Upon malfunctions, the spikes may not be supplied with proper orientation to the spike hammer.

OBJECTS AND SUMMARY OF THE INVENTION

Accordingly, it is a primary object of the present invention to provide a new and improved tie plate track fastener feeder for feeding regular spikes, hairpin or lock spikes, coach screws, and others. (For simplicity, the discussion which follows will emphasize use for spikes, but it will be understood that the word spike may be replaced by the more general expression tie plate track fastener hereafter.)

A more specific object of the present invention is to provide a spike feeder which is highly reliable, especially in securing spikes in proper orientation for a spiking head to insert them. (As used herein, a spiking head is the machine part which pushes, hammers, or otherwise inserts any type of tie plate track fastener through a tie plate into a tie.)

A further object of the present invention is to provide a spike feeder where the spikes are released from a spike storage area to assume a secure position only upon reaching a spike holder and without the need for assuming a secure position on an intermediate spike holder.

Yet another object of the present invention is to provide a spike feeder using a simple and quite reliable mechanism to hand off a spike from the spike chute or other spike storage area to the spike holder.

A further object of the present invention is to provide a tie plate track fastener feeder combined with a vehicle including a spiking head.

The above and other features of the present invention which will be more readily understood when the following detailed description is considered in conjunction with the accompanying drawings are realized by a rail tie plate track fastener feeder including: a tie plate track fastener storage area operable to hold a plurality of spikes therein; a releaser operable to release one tie plate track fastener at a time from the tie plate track fastener storage area; a holder positioned and operable to receive spikes, one at a time, released by the releaser, the holder providing the first secure positioning of a tie plate track fastener after its release by the releaser; and a holder actuator operably connected to the holder for moving the holder between an upper tie plate track fastener receiving position and a lower spiking position whereat a spiking head may begin inserting a tie plate track fastener into a tie plate and tie. (As used herein, spiking position will be the position of a tie plate track fastener whereat a spiking head begins pushing, hammering, or otherwise inserting the tie plate track fastener such as a spike, hairpin or lock spike, or coach screw.)

A first link supports the holder and movement of the holder from its tie plate track fastener receiving position to its spiking position includes the first link pivoting about a first link axis and the holder pivoting about a first holder axis relative to the first link, the first holder axis being separate and non-colinear from the first link axis. A second link supports the holder and wherein movement of the holder from its tie plate track fastener receiving position to its spiking position includes the second link pivoting about a second link axis and the holder pivoting about a second holder axis relative to the second link, the second holder axis being separate and non-colinear from the first second axis. The first and second links extend lengthwise in parallel, the first and second link axes are parallel to each other, and the first and second holder axes are parallel to each other.

The holder is a block and the first and second links and block are part of a four bar linkage which maintains the orientation of the block as the first and second links are pivoted. The tie plate track fastener storage area is a chute.

The releaser includes first and second gates, the first gate operable to hold back a plurality of spikes in the chute when the second gate releases a lowest tie plate track fastener in the chute.

A finger assembly is pivotably mounted adjacent a lower end of the chute and operable to move under the weight of a tie plate track fastener from an upper tie plate track fastener reception position to a lower tie plate track fastener handoff position whereat a tie plate track fastener is passed to the holder, the finger assembly operable to provide a tie plate track fastener with movement thereon even as the finger assembly is moving and operable to insure proper orientation of a tie plate track fastener as it is passed to the holder.

The holder is operable to maintain an initial tie plate track fastener orientation from when a tie plate track fastener assumes its secure positioning relative to the holder through when the holder moves to its spiking position.

The present invention may alternately be described as a rail tie plate track fastener feeder including: a tie plate track fastener storage area operable to hold a plurality of spikes therein; a releaser operable to release one tie plate track fastener at a time from the tie plate track fastener storage area; a holder positioned and operable to receive tie plate track fasteners, one at a time, released by the releaser; a holder actuator operably connected to the holder for moving the holder between an upper tie plate track fastener receiving position and a lower spiking position whereat a spiking head may begin inserting a tie plate track fastener into a tie plate and tie; and a finger assembly pivotably mounted adjacent a lower end of the tie plate track fastener storage area and operable to move under the weight of a tie plate track fastener from an upper tie plate track fastener reception position to a lower tie plate track fastener handoff position whereat a tie plate track fastener is passed to the holder, the finger assembly operable to provide a tie plate track fastener with movement thereon even .as the finger assembly is moving and operable to insure proper orientation of a tie plate track fastener as it is passed to the holder.

The finger assembly comprises two opposite side fingers with a tie plate track fastener accommodating slot therebetween. The finger assembly is counterweighted such that it automatically moves from its handoff position to its reception position upon passing of a tie plate track fastener to the holder. The holder provides the first secure positioning of a tie plate track fastener after its release by the releaser. The holder is operable to maintain an initial tie plate track fastener orientation from when a tie plate track fastener assumes its secure positioning relative to the holder through when the holder moves to its spiking position.

The present invention may alternately be described as a rail tie plate track fastener feeder including: a tie plate track fastener storage area operable to hold a plurality of tie plate track fasteners therein; a releaser operable to release one tie plate track fastener at a time from the tie plate track fastener storage area; a holder positioned and operable to receive tie plate track fasteners, one at a time, released by the releaser, the holder providing the first secure positioning of a tie plate track fastener after its release by the releaser; and a holder actuator operably connected to the holder for moving the holder between an upper tie plate track fastener receiving position and a lower spiking position whereat a spiking head may begin inserting a tie plate track fastener into a tie plate and tie. The holder is operable to maintain an initial tie plate track fastener orientation from when a tie plate track fastener assumes a secure positioning relative to the holder through when the holder moves to its spiking position. The tie plate track fastener feeder is combined with a vehicle having a frame with rail engagement wheels supporting the frame and a spiking head supported by the frame and positioned to insert tie plate track fasteners placed in the spiking position by the holder.

BRIEF DESCRIPTION OF THE DRAWINGS

The above and other features of the present invention will be more readily understood when the following detailed description is considered in conjunction with the accompanying drawings wherein like characters represent like parts throughout the several views and in which:

FIG. 1 is a schematic side view of a spiker vehicle according to the present invention;

FIG. 2 is a perspective view of a spike feeder of the present invention combined with a spike hammer and its mounting;

DETAILED DESCRIPTION

Figure 3:
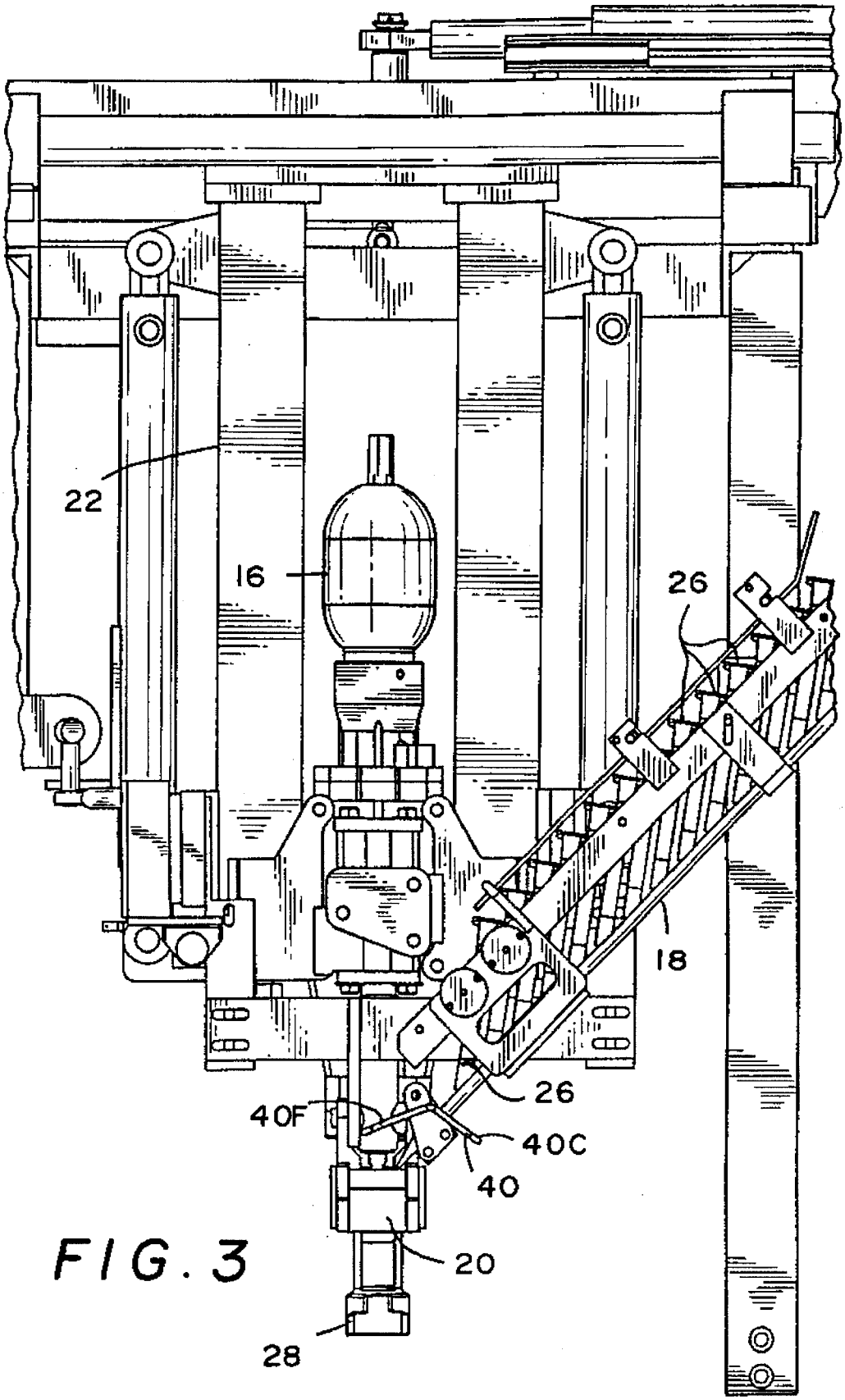
FIG. 3 is a side view of portions of the arrangement of FIG. 2.

FIG. 1 shows a spiker vehicle 10 having front and back pairs of wheels 12 rolling on rails such as R and having a main frame 14. A spiker 16, spike chute 18, and spike feeder 20, shown schematically in FIG. 1, are supported directly or indirectly by main frame 14. Since the components of vehicle 10 are relatively standard except for spike feeder 20 and its relationship to chute 18, the other components need not be discussed in detail. Various of the other components may be realized using the components of the incorporated by reference patents. The description will concentrate on chute 18, feeder 20, and related components such as spiker 16.

With reference now to FIGS. 2 and 3, the spiker 16 is mounted on a carriage 22 moving along a rod 24 for placement over the hole in a tie plate. The present invention is not concerned with the details of the mounting of spiker 16 or the operation of the spiker 16 itself since both of these may be realized using known techniques. However, the overall operation of the apparatus will be discussed. A single spike from spikes 26 stored in chute 18 is fed into holder 20 which then swings under spiking head 28 of spiker 16. The head 28 then pushes or hammers the spike into a tie (not shown).

Figure 5:
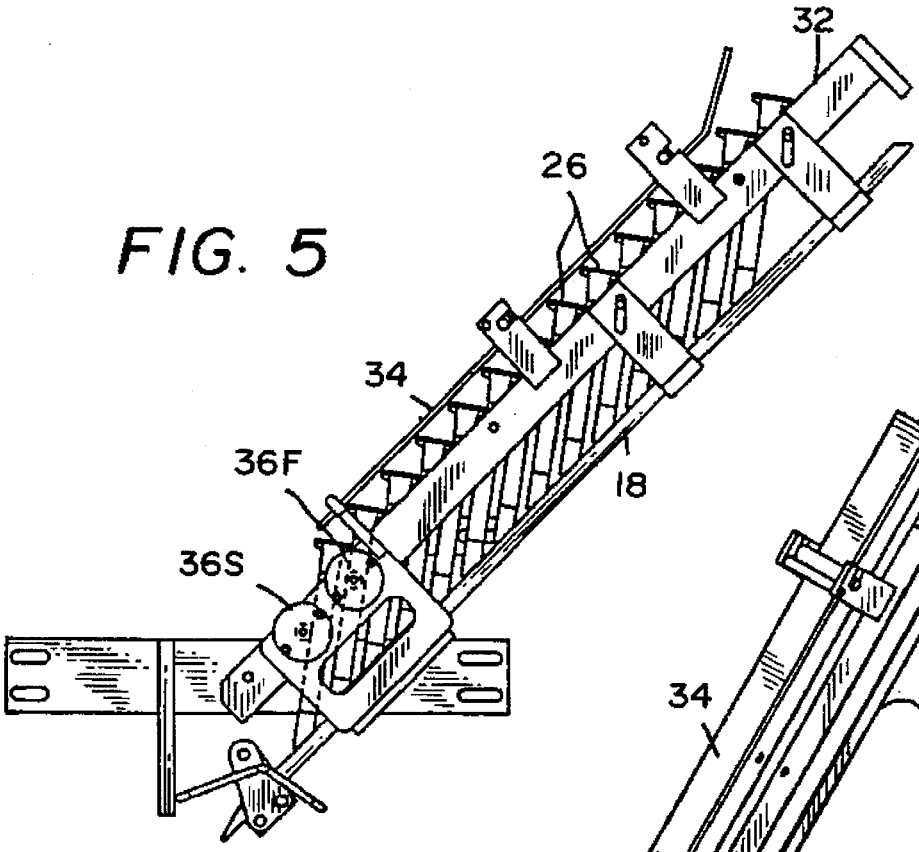
FIG. 5 is a side view of the spike feeder with some portions removed at a lower end thereof.
Figure 4:
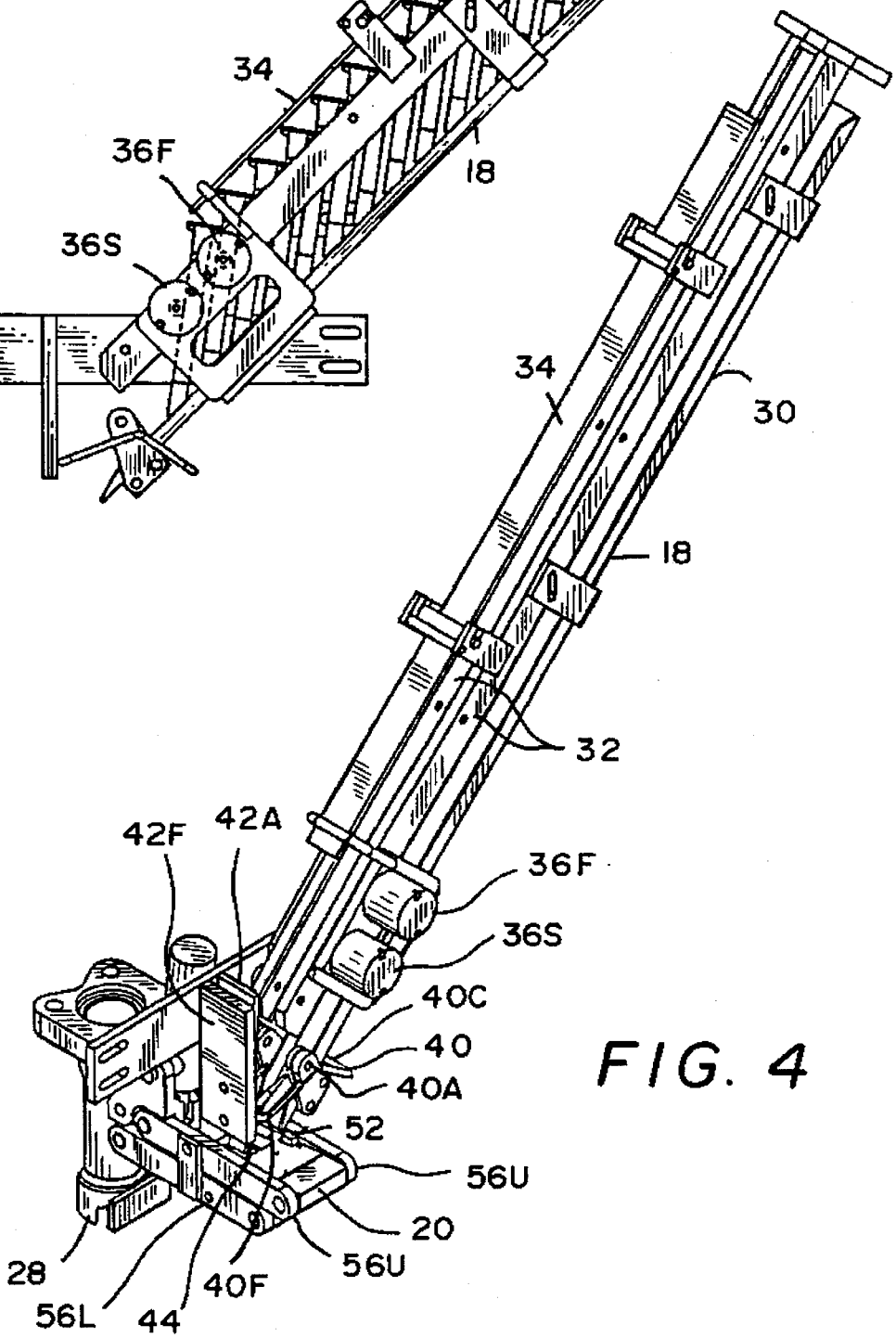
FIG. 4 is a perspective view of the spike feeder.
Figure 6:
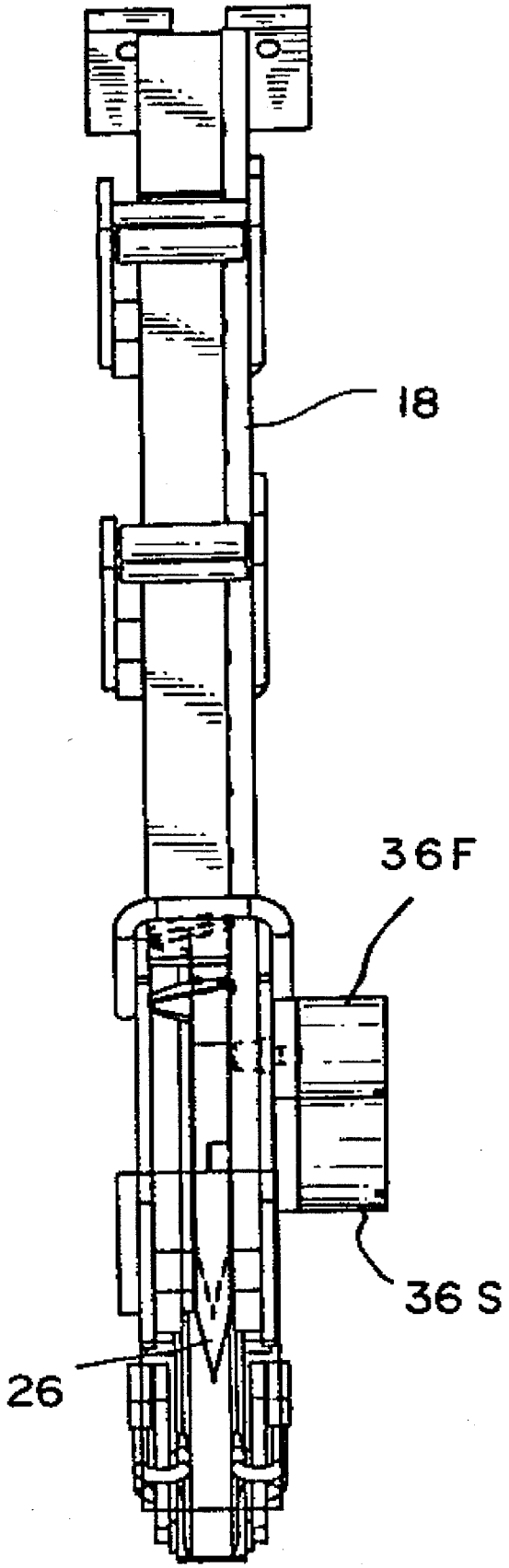
FIG. 6 is an end view of portions of the spike feeder looking towards a lower end of a spike chute.

Turning now to FIGS. 4, 5, and 6, the details of chute 18, holder 20 (FIG. 4 only), and related parts collectively form a spike feeder for feeding spikes to a spiking position (i.e., position for insertion of tie plate track fastener) for spiking by use of spiking head or ram guide part 28 (FIG. 4 only). Chute 18 has a floor 30, opposite side walls 32, and ceiling or top 34 such that spikes 26 (FIGS. 5 and 6 only) may be stored therein. The chute 18 (including its floor 30) is inclined down such that gravity causes the spikes 26 to move downwardly unless other spikes or a releaser having first and second gates 36F and 36S block their downward path.

Figures 7A, 7B, 7C, 7D:
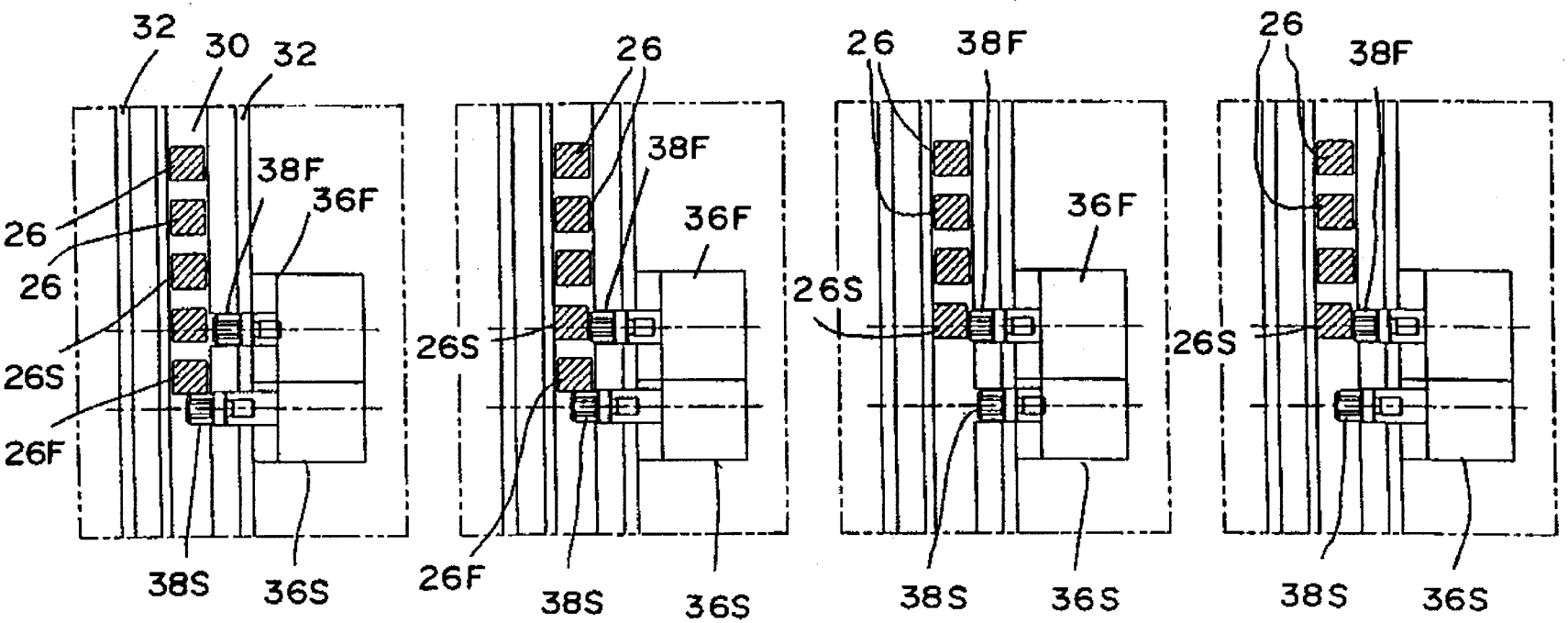
FIGS. 7A through 7D are top sequential views showing how a releaser arrangement releases one spike at a time from the spike chute.

With reference now to sequential top views of FIGS. 7A through 7D, gates 36F and 36S are pneumatic or hydraulic cylinders having piston gating members 38F and 38S which extend and retract to respectively block and release spikes. In FIG. 7A, gating member 38S is extended to block lower or first spike 26F from leaving chute 18. The remainder of the spikes including second spike 26S are also blocked from downward movement. Before gating member 38S is retracted to release spike 26F, gating member 38F is extended (FIG. 7B) to secure spike 26S and the spikes up the incline of chute 18 therefrom. In FIG. 7C, the gating member 38S has been retracted such that spike 26F will have been released and is not shown therein. In FIG. 7D, the gating member 38S has been extended such that gating member 38F may next be retracted to resume the FIG. 7A position except that spike 26S would be in the lowest position on the chute 18. Thus, the releaser composed of the gates 36F and 36S repeatedly releases one spike at a time.

With reference now to FIGS. 3, 4, and, primarily, 8A through 8H, a finger assembly 40 is pivotably mounted at axis 40A on the lower end of chute 18, The finger assembly 40, which is symmetric about a vertical plane extending through the center of chute 18, has a counterweight loop portion 40C. The counterweight loop portion 40C normally maintains finger portions 40F (only one visible, see especially FIGS. 4 and 8A, but identical one is on other side) in the position of FIG. 3.

Figure 8A:
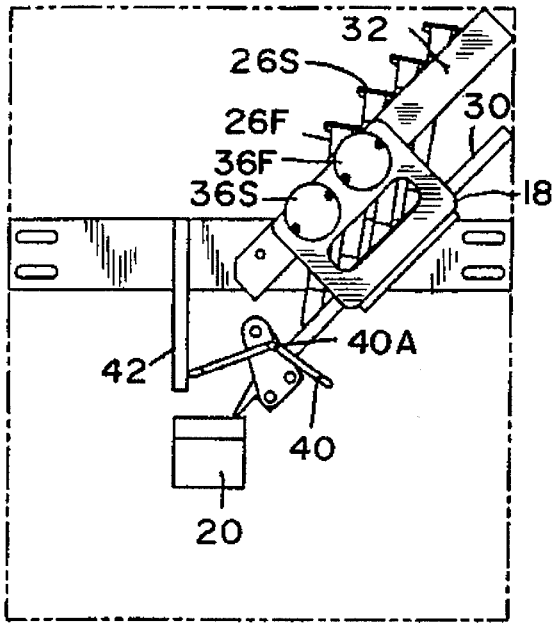
FIGS. 8A through 8G are side sequential views illustrating the hand off or pass over of a spike from the spike chute to a spike holder.
Figure 8B:
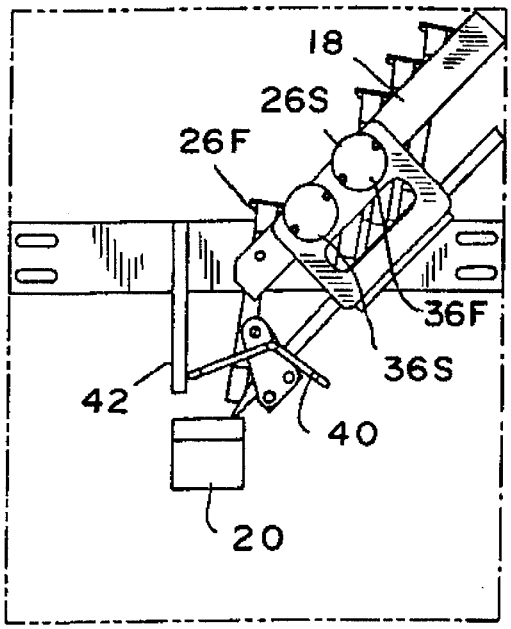
Figure 8E:
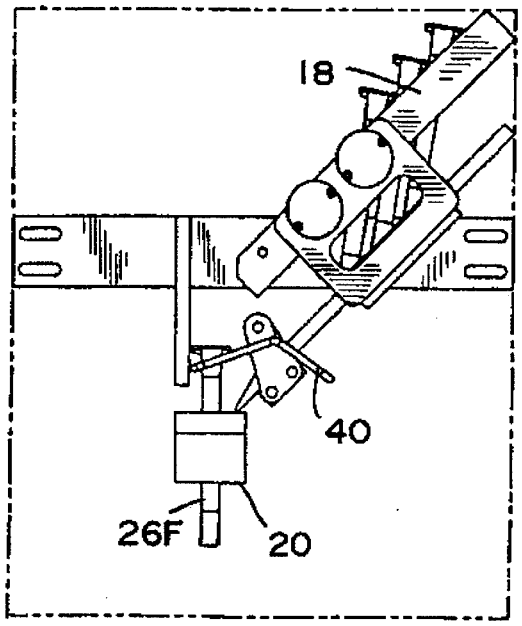
Figure 8F:
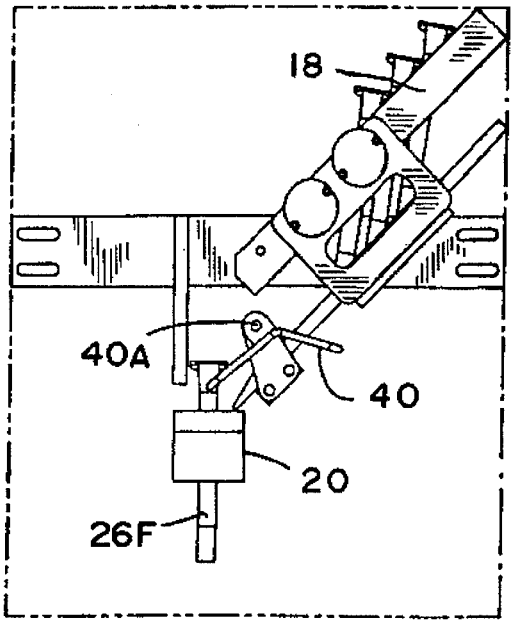
Figure 8C:
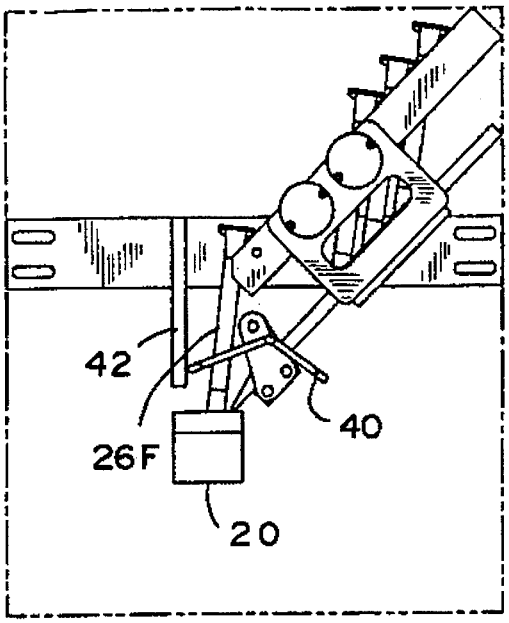
Figure 8D:
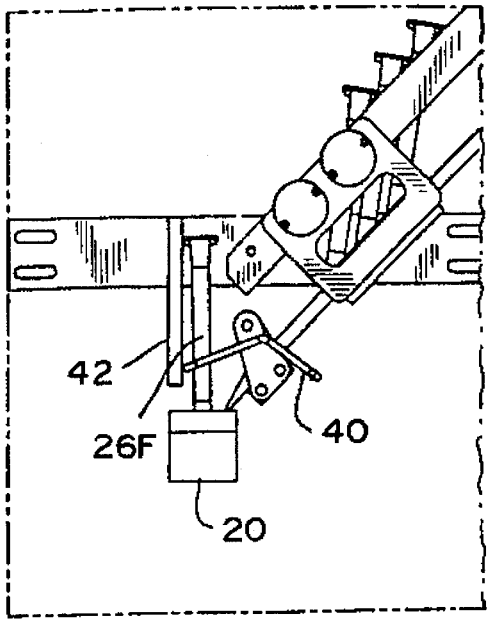
Figure 8G:
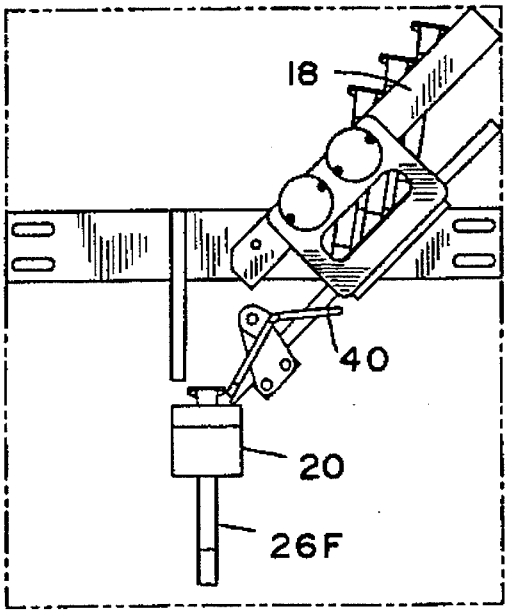
Figure 8H:
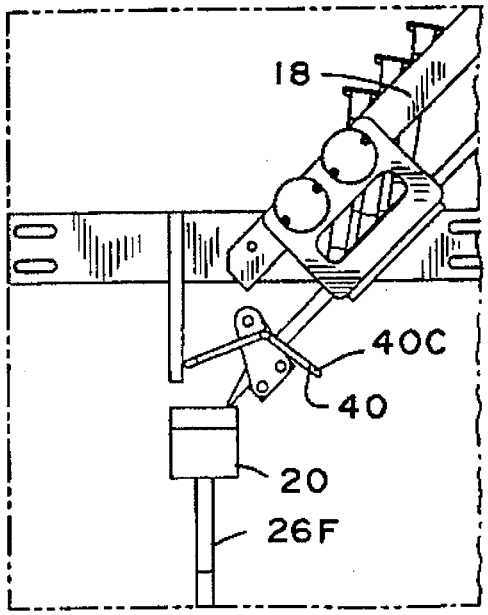
Figure 9A:
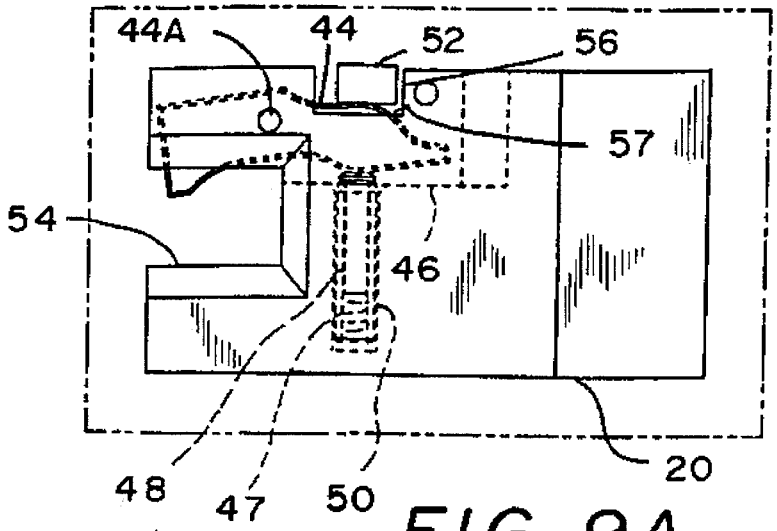
FIGS. 9A through 9E are top sequential views illustrating entry of a spike into the spike holder.

From the position of FIG. 8A, gating member 36S is retracted to release spike 26S which slides under gravity to the positions of FIGS. 8B, 8C, and 8D in sequence. In position 8D, the spike 26F has contacted a bang board 42 mounted adjacent the lower end of chute 18. Bang board 42 may have an adjustable board 42A attached to a fixed board 42F (FIG. 4 only) to allow adjustment of operation of the board or may be a single board 42 such as shown in FIGS. 8A through 8H. In either case, the banging of the spike into the bang board, stops its leftward (i.e., in the view from FIG. 8D) movement. Spike 26F then starts dropping into spike holder block 20 as shown in FIG. 8E. In FIG. 8F, the weight of spike 26F on the finger assembly 40 starts pivoting assembly 40 about axis 40A until the head of spike 26F has dropped free of the finger assembly 40 in its spike hand off position of FIG. 8G. As spike 26F drops into a secure position in holder 20, the counterweight portion 40C causes finger assembly 40 to pivot clockwise into their reception position of FIG. 8H for receiving the next spike. With reference now momentarily to FIG. 4 and then to FIGS. 9A through 9E, the operation of holder block 20 will be discussed. A solid pawl 44 has chamfered edges and is pivotably mounted at vertical axis 44A. Pawl 44 is mounted within a horizontally oriented milled out cavity 46 in block 20 and is normally biased in a counterclockwise direction by spring 47 pushing against spring pin 48 mounted within a cylindrical cavity 50 milled out in block 20. However, cam 52 compresses spring 47 in the FIG. 9A position such that pawl 44 is pulled back from a spike accommodating slot 54. The cam 52 is mounted to an upper link 56U (not shown in FIG. 9A, refer to FIG. 4) and has an inclined or tapered surface (not shown) to avoid binding with the chamfered edge of pawl 44. When block 20 is in its FIG. 4 position, cam 52 enters milled out cavity 57 in block 20 in order to push pawl 44 to its FIG. 9A position. The block 20 is swung down as will be discussed below in more detail relative to FIGS. 10.A through 10G.

Figure 9B:
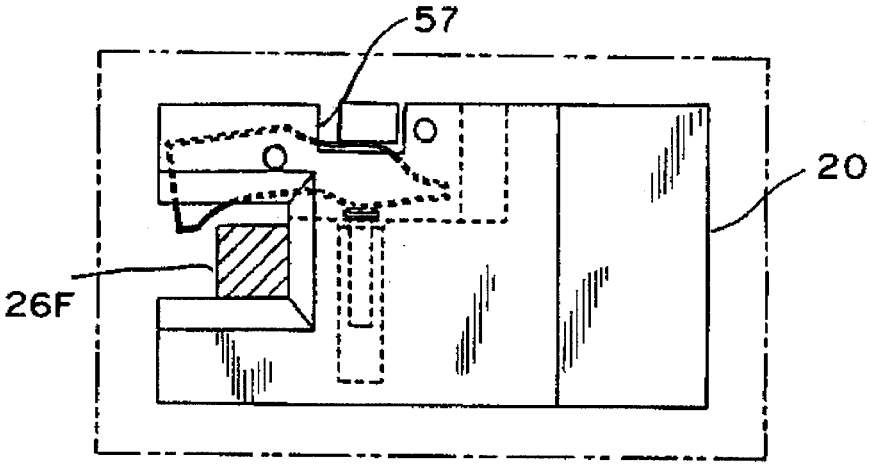
Figure 9C:
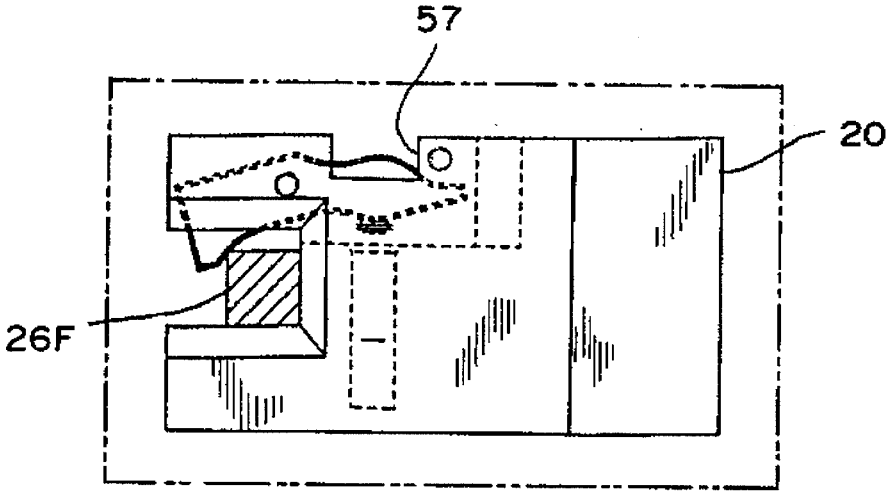
Figure 9D:
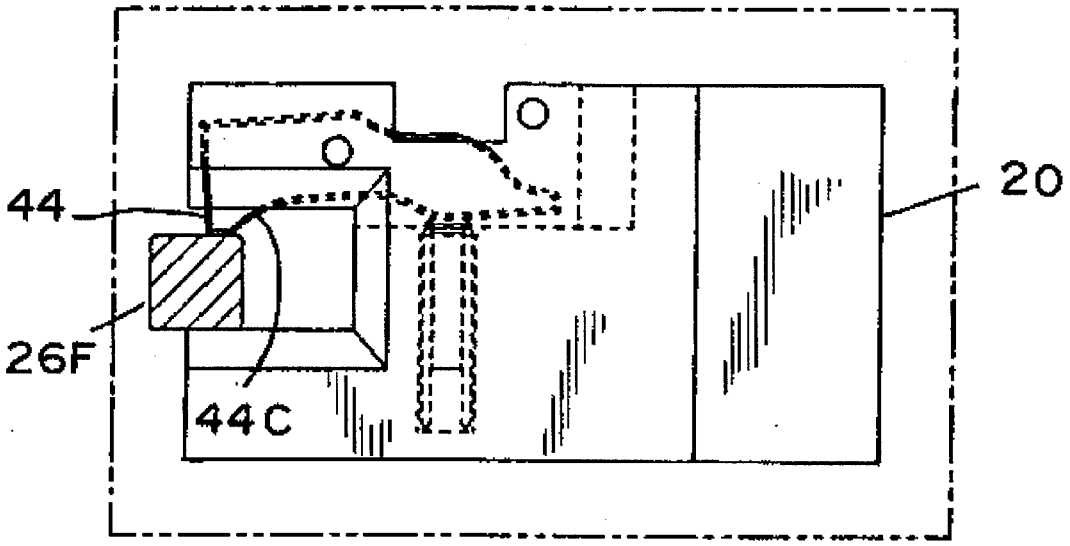
Figure 9E:
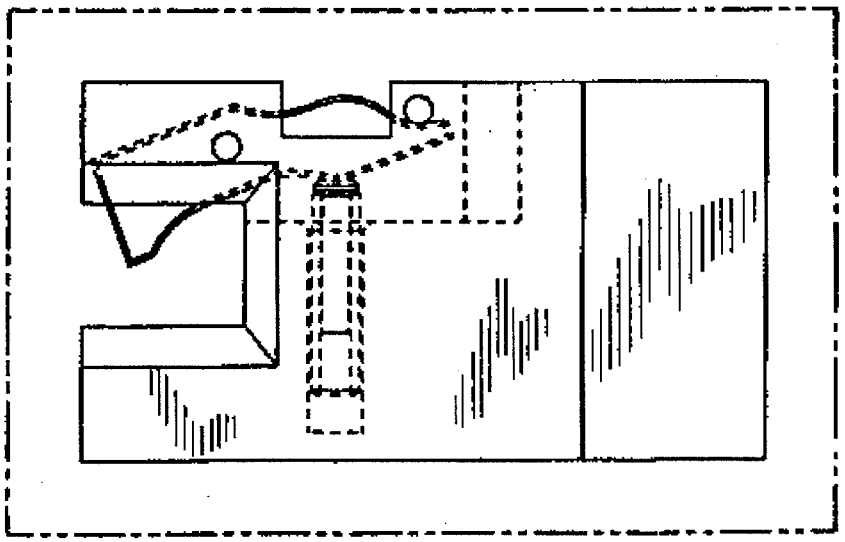

In FIG. 9B, the spike 26F has been dropped in the slot 54 by the process described above in FIG. 9C, the block 20 has been moved such that cam 52 (not shown) is no longer in cavity 57. Pawl 52 grips the spike 26F and the block 20 is lowered until the spike 26F hits a tie (not shown) and is stopped from further lowering, while block 20 continues down. The spiking head 28 (refer back to FIG. 4) then inserts the spike from this spiking position. As block 20 is swung up, spike 26F slides out of 54 along curved edge 44C of pawl 44 (FIG. 9D) and pawl 44 then goes into its FIG. 9E position.

Figure 10A:
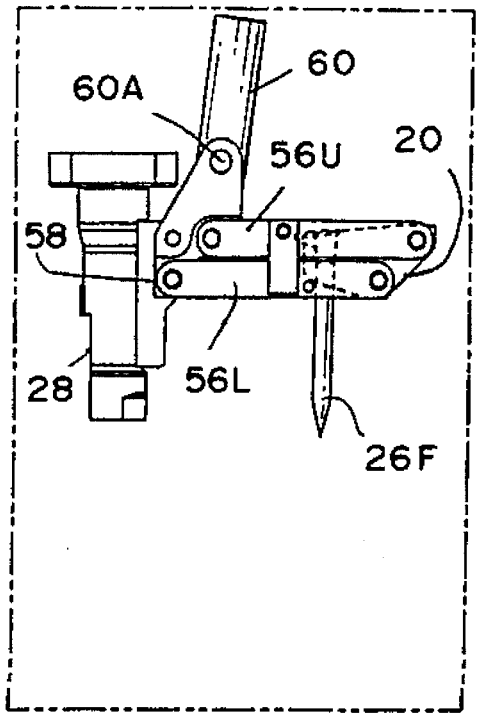
FIGS. 10A through 10G are side sequential views showing the operation .of the spike holder.
Figure 10B:
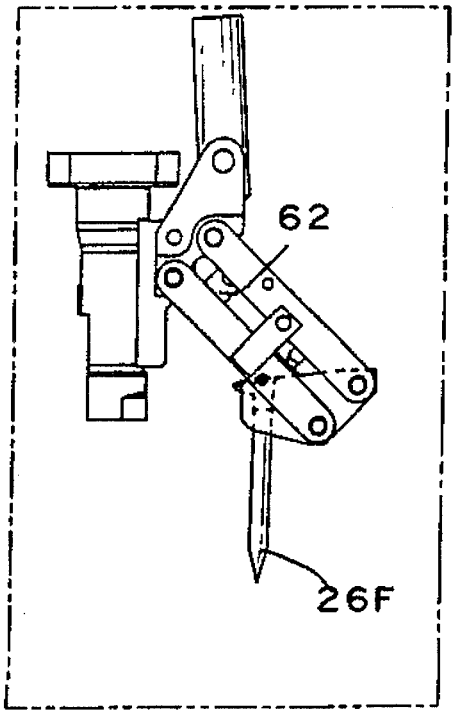
Figure 10E:
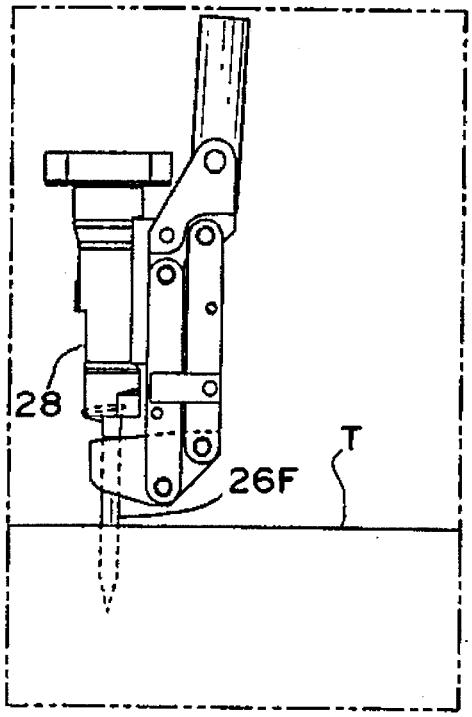
Figure 10F:
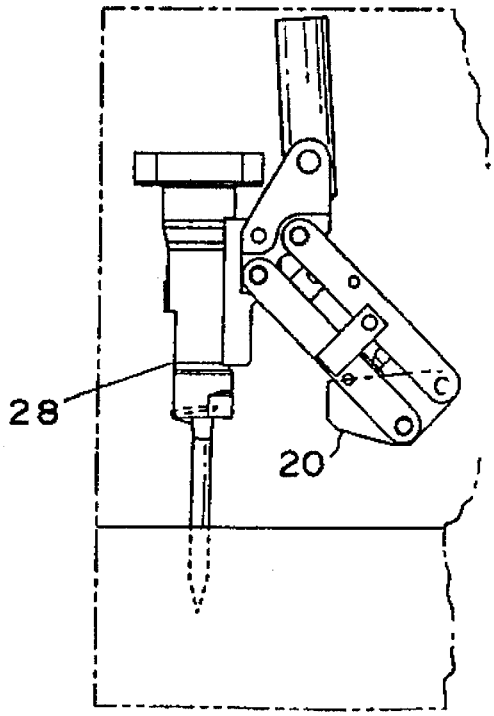
Figure 10C:
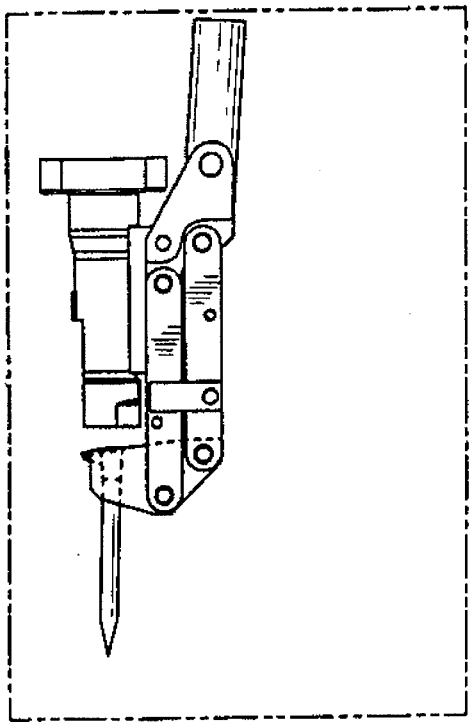
Figure 10D:
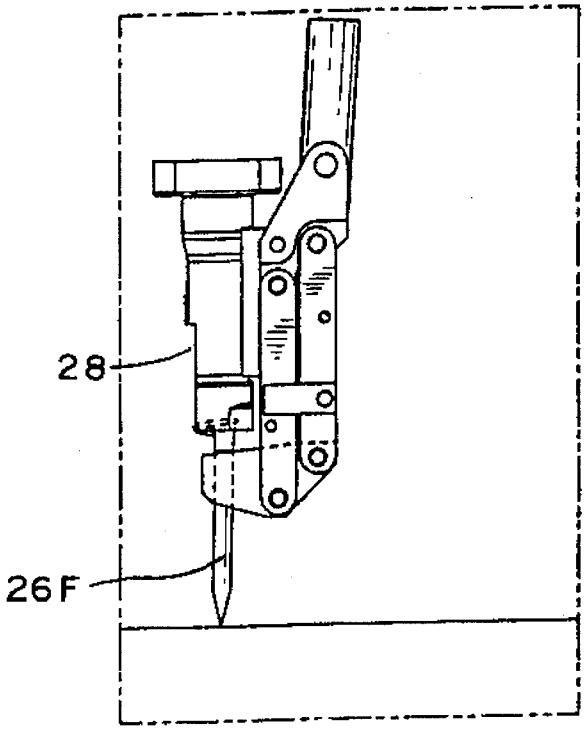
Figure 10G:
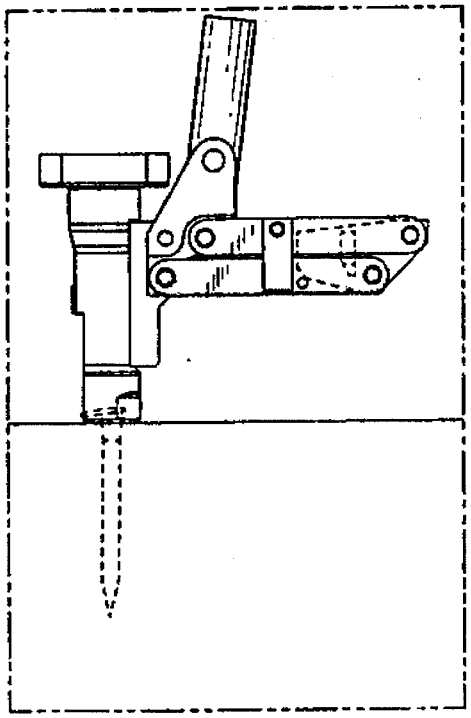

With reference now to FIGS. 10A through 10G, block 20 is pivotably mounted to ends of two pairs of upper and lower links 56U and 56L. The opposite ends of the links are pivotably mounted at support 58, which also supports a trunnion mounted holder actuator 60 pivotably about axis 60A. A piston end of actuator 60 is pivotably attached to mount 62 (FIG. 10B), which in turn is mounted to links 56L 56U. As actuator 60 extends, links 56U and 56L are part of a four bar linkage maintaining the orientation of holder 20 and spike 26F through positions of FIGS. 10B–10D. In FIG. 10D, the spike 26F is in a spiking position from which it is inserted in a tie as shown in FIG. 10E. (No tie plate is shown for ease of illustration.) In FIG. 10F, the holder block 20 is swung away from the spiking head 28 which completes the insertion in FIG. 10G.

In FIG. 10A, as in FIG. 4, the holder 20 is in an upper spike or tie plate fastener receiving position whereat a tie plate track fastener is initially supplied to the holder. In FIG. 10C, the holder has moved to a lower spiking position whereat a spiking head may begin inserting a tie plate track fastener into a tie plate and tie. The holder actuator 60 (FIG. 10A) moves the holder so as to change a position of a tie plate track fastener (26F in FIG. 10A) in the holder in its upper tie plate track fastener receiving position horizontally and vertically offset from a position of a tie plate track fastener (26F in FIG. 10C) in the holder in its lower spiking position. The holder 20 includes a holder portion 54 (FIG. 9A) in which a tie plate track fastener sits and wherein a tie plate track fastener is stationary relative to the holder portion as the holder moves between its upper tie plate track fastener receiving position and its lower spiking position. A first link 56U supporting the holder 20. Movement of the holder 20 from its tie plate track fastener receiving position to its spiking position includes the first link pivoting about a first link axis (axis corresponding to pivot point at left end of link 56U in FIG. 10A) and the holder pivoting about a first holder axis (axis corresponding to pivot point at right end of link 56U in FIG. 10A) relative to the first link. As apparent from FIGS. 10A–10C, the first holder axis is separate and non-collinear relative to the first link axis. Lower link 56L can be considered as a second link supporting the holder 20. Movement of the holder from its tie plate track fastener receiving position to its spiking position includes the second link pivoting about a second link axis (axis corresponding to pivot point at left end of link 56L in FIG. 10A) and the holder pivoting about a second holder axis (axis corresponding to pivot point at right end of link 56L in FIG. 10A) relative to the second link. The second holder axis is separate and non-collinear relative to the first second axis. As shown in FIGS. 10A–10G, the first and second links extend lengthwise in parallel, the first and second link axes are parallel to each other, and the first and second holder axes are parallel to each other. As also shown therein, the holder is operable to maintain an initial tie plate track fastener orientation from when a tie plate track fastener assumes its secure positioning relative to the holder 20 through when the holder moves to its spiking position. Further, and as shown, the holder is operable to independently secure a tie plate track fastener up to the beginning of the inserting, meaning that components independent from the holder are not used for the securing of the spike from the time it is received by the holder until the insertion into a tie plate begins.

Although specific constructions have been presented herein, it is to be understood that these are for illustrative purposes only. Various modifications and adaptations will be apparent to those of skill in the art. In view of possible modifications, it will be appreciated that the scope of the present invention should be determined by reference to the claims appended hereto.

What is claimed is:

1. A rail tie plate fastener feeder comprising:

a tie plate fastener storage area operable to hold a plurality of tie plate track fasteners therein;

a releaser operable to release one tie plate track fastener at a time from the tie plate track fastener storage area;

a holder positioned and operable to receive tie plate track fasteners, one at a time, released by the releaser, the holder providing the first secure positioning of a tie plate track fastener after its release by the releaser; and a holder actuator operably connected to the holder for moving the holder between an upper tie plate track fastener receiving position whereat a tie plate track fastener is initially supplied to the holder and a lower spiking position whereat a spiking head may begin inserting a tie plate track fastener into a tie plate and tie; and wherein the holder actuator moves the holder so as to change a position of a tie plate track fastener in the holder in its upper tie plate track fastener receiving position horizontally and vertically offset from a position of a tie plate track fastener in the holder in its lower spiking position, and wherein the holder includes a holder portion in which a tie plate track fastener sits and wherein a tie plate track fastener is stationary relative to the holder portion as the holder moves between its upper tie plate track fastener receiving position and its lower spiking position.

2. A rail tie plate fastener feeder comprising:

a tie plate fastener storage area operable to hold a plurality of tie plate track fasteners therein;

a releaser operable to release one tie plate track fastener at a time from the tie plate track fastener storage area;

a holder positioned and operable to receive tie plate track fasteners, one at a time, released by the releaser, the holder providing the first secure positioning of a tie plate track fastener after its release by the releaser; and a holder actuator operably connected to the holder for moving the holder between an upper tie plate track fastener receiving position and a lower spiking position whereat a spiking head may begin inserting a tie plate track fastener into a tie plate and tie; and further comprising a first link supporting the holder and wherein movement of the holder from its tie plate track fastener receiving position to its spiking position includes the first link pivoting about a first link axis and the holder pivoting about a first holder axis relative to the first link, the first holder axis being separate and non-collinear from the first link axis.

3. The rail tie plate track fastener feeder of claim 2 further comprising a second link supporting the holder and wherein movement of the holder from its tie plate track fastener receiving position to its spiking position includes the second link pivoting about a second link axis and the holder pivoting about a second holder axis relative to the second link, the second holder axis being separate and non-collinear from the first second axis.

4. The rail tie plate track fastener feeder of claim 3 wherein the first and second links extend lengthwise in parallel, the first and second link axes are parallel to each other, and the first and second holder axes are parallel to each other.

5. The rail tie plate track fastener feeder of claim 4 wherein the holder is a block and the first and second links and block are part of a four bar linkage which maintains the orientation of the block as the first and second links are pivoted.

6. The rail tie plate track fastener feeder of claim 5 wherein the tie plate track fastener storage area is a chute.

7. The rail tie plate track fastener feeder of claim 6 wherein the releaser includes first and second gates, the first gate operable to hold back a plurality of tie plate track fasteners in the chute when the second gate releases a lowest tie plate track fastener in the chute.

8. The rail tie plate track fastener feeder of claim 6 further comprising a finger assembly pivotably mounted adjacent a lower end of the chute and operable to move under the weight of a tie plate track fastener from an upper tie plate track fastener reception position to a lower tie plate track fastener handoff position whereat a tie plate track fastener is passed to the holder, the finger assembly operable to provide a tie plate track fastener with movement thereon even as the finger assembly is moving and operable to properly orient a tie plate track fastener as it is passed to the holder.

9. The rail tie plate track fastener feeder of claim 1 wherein the holder is operable to maintain an initial tie plate track fastener orientation from when a tie plate track fastener assumes its secure positioning relative to the holder through when the holder moves to its spiking position; and wherein the holder is operable to independently secure a tie plate track fastener up to the beginning of the inserting.

10. A rail tie plate fastener feeder comprising:

a tie plate fastener storage area operable to hold a plurality of tie plate track fasteners therein;

a releaser operable to release one tie plate track fastener at a time from the tie plate track fastener storage area;

a holder positioned and operable to receive tie plate track fasteners, one at a time, released by the releaser, the holder providing the first secure positioning of a tie plate track fastener after its release by the releaser; and a holder actuator operably connected to the holder for moving the holder between an upper tie plate track fastener receiving position and a lower spiking position whereat a spiking head may begin inserting a tie plate track fastener into a tie plate and tie; and further comprising a finger assembly pivotably mounted adjacent a lower end of the tie plate track fastener storage area and operable to move under the weight of a tie plate track fastener from an upper tie plate track fastener reception position to a lower tie plate track fastener handoff position whereat a tie plate track fastener is passed to the holder, the finger assembly operable to provide a tie plate track fastener with movement thereon even as the finger assembly is moving and operable to properly orient a tie plate track fastener as it is passed to the holder.

11. A rail tie plate track fastener feeder comprising:

a tie plate track fastener storage area operable to hold a plurality of tie plate track fasteners therein;

a releaser operable to release one tie plate track fastener at a time from the tie plate track fastener storage area;

a holder positioned and operable to receive tie plate track fasteners, one at a time, released by the releaser;

a holder actuator operably connected to the holder for moving the holder between an upper tie plate track fastener receiving position and a lower spiking position whereat a spiking head may begin inserting a tie plate track fastener into a tie plate and tie; and a finger assembly pivotably mounted adjacent a lower end of the tie plate track fastener storage area and operable to move under the weight of a tie plate track fastener from an upper tie plate track fastener reception position to a lower tie plate track fastener handoff position whereat a tie plate track fastener is passed to the holder, the finger assembly operable to provide a tie plate track fastener with movement thereon even as the finger assembly is moving and operable to insure proper orientation of a tie plate track fastener as it is passed to the holder.

12. The rail tie plate track fastener feeder of claim 11 wherein the finger assembly comprises two opposite side fingers with a tie plate track fastener accommodating slot therebetween.

13. The rail tie plate track fastener feeder of claim 12 wherein the finger assembly is counterweighted such that it automatically moves from its handoff position to its reception position upon passing of a tie plate track fastener to the holder.

14. The rail tie plate track fastener feeder of claim 13 wherein the holder provides the first secure positioning of a tie plate track fastener after its release by the releaser.

15. The rail tie plate track fastener feeder of claim 14 wherein the holder is operable to maintain an initial tie plate track fastener orientation from when a tie plate track fastener assumes its secure positioning relative to the holder through when the holder moves to its spiking position.

16. A rail tie plate track fastener feeder comprising:

a tie plate track fastener storage area operable to hold a plurality of tie plate track fasteners therein;

a releaser operable to release one tie plate track fastener at a time from the tie plate track fastener storage area;

a holder positioned and operable to receive tie plate track fasteners, one at a time, released by the releaser, the holder providing the first secure positioning of a tie plate track fastener after its release by the releaser; and a holder actuator operably connected to the holder for moving the holder between an upper tie plate track fastener receiving position and a lower spiking position whereat a spiking head may begin inserting a tie plate track fastener into a tie plate and tie; and wherein the holder is operable to maintain an initial tie plate track fastener orientation from when a tie plate track fastener assumes a secure positioning relative to the holder through when the holder moves to its spiking position; and wherein the holder includes a holder portion in which a tie plate track fastener sits and wherein a tie plate track fastener is stationary relative to the holder portion as the holder moves between its upper tie plate track fastener receiving position and its lower spiking position.

17. A rail tie plate track fastener feeder comprising:

a tie plate track fastener storage area operable to hold a plurality of tie plate track fasteners therein;

a releaser operable to release one tie plate track fastener at a time from the tie plate track fastener storage area;

a holder positioned and operable to receive tie plate track fasteners, one at a time, released by the releaser, the holder providing the first secure positioning of a tie plate track fastener after its release by the releaser; and a holder actuator operably connected to the holder for moving the holder between an upper tie plate track fastener receiving position and a lower spiking position whereat a spiking head may begin inserting a tie plate track fastener into a tie plate and tie; and wherein the holder is operable to maintain an initial tie plate track fastener orientation from when a tie plate track fastener assumes a secure positioning relative to the holder through when the holder moves to its spiking position; and further comprising a finger assembly pivotably mounted adjacent a lower end of the tie plate track fastener storage area and operable to move under the weight of a tie plate track fastener from an upper tie plate track fastener reception position to a lower tie plate track fastener handoff position whereat a tie plate track fastener is passed to the holder, the finger assembly operable to provide a tie plate track fastener with movement thereon even as the finger assembly is moving and operable to properly orient a tie plate track fastener as it is passed to the holder.

18. A rail tie plate track fastener feeder comprising:

a tie plate track fastener storage area operable to hold a plurality of tie plate track fasteners therein;

a releaser operable to release one tie plate track fastener at a time from the tie plate track fastener storage area;

a holder positioned and operable to receive tie plate track fasteners, one at a time, released by the releaser, the holder providing the first secure positioning of a tie plate track fastener after its release by the releaser; and a holder actuator operably connected to the holder for moving the holder between an upper tie plate track fastener receiving position and a lower spiking position whereat a spiking head may begin inserting a tie plate track fastener into a tie plate and tie; and wherein the holder is operable to maintain an initial tie plate track fastener orientation from when a tie plate track fastener assumes a secure positioning relative to the holder through when the holder moves to its spiking position; and further comprising a first link supporting the holder and wherein movement of the holder from its tie plate track fastener receiving position to its spiking position includes the first link pivoting about a first link axis and the holder pivoting about a first holder axis relative to the first link, the first holder axis being separate and non-collinear from the first link axis.

19. The rail tie plate track fastener feeder of claim 18 further comprising a second link supporting the holder and wherein movement of the holder from its tie plate track fastener receiving position to its spiking position includes the second link pivoting about a second link axis and the holder pivoting about a second holder axis relative to the second link, the second holder axis being separate and non-collinear from the first second axis, and wherein the first and second links extend lengthwise in parallel, the first and second link axes are parallel to each other, and the first and second holder axes are parallel to each other.

20. The rail tie plate track fastener feeder of claim 16 combined with a vehicle having a frame with rail engagement wheels supporting the frame and a spiking head supported by the frame and positioned to insert tie plate track fasteners placed in the spiking position by the holder.

* * * * *